US008267275B2

(12) United States Patent
Peitersen

(10) Patent No.: US 8,267,275 B2
(45) Date of Patent: Sep. 18, 2012

(54) BEVERAGE CONTAINER TOP HAVING A RESERVOIR FOR LIQUID COOLING

(75) Inventor: Stig E. Peitersen, Lufkin, TX (US)

(73) Assignee: Stig E. Peitersen, Lufkin, TX (US)

( * ) Notice: Subject to any disclaimer, the term of this patent is extended or adjusted under 35 U.S.C. 154(b) by 1587 days.

(21) Appl. No.: 11/009,933

(22) Filed: Dec. 11, 2004

(65) Prior Publication Data

US 2006/0124645 A1 Jun. 15, 2006

(51) Int. Cl.

| | |
|---|---|
| ***B65D 51/16*** | (2006.01) |
| ***B65D 1/24*** | (2006.01) |
| ***A47G 19/22*** | (2006.01) |
| *B65D 3/00* | (2006.01) |

(52) U.S. Cl. ..... 220/374; 220/713; 220/718; 220/719; 220/521; 229/404

(58) Field of Classification Search ..... 220/521, 220/713, 719, 374, 373, 367.1, 716, 717, 220/711.368, 718; 229/404, 906.1
See application file for complete search history.

(56) References Cited

U.S. PATENT DOCUMENTS

| | | | | |
|---|---|---|---|---|
| 3,806,023 | A | 4/1974 | Barnett | |
| 4,460,101 | A * | 7/1984 | Tseng | 215/307 |
| 4,531,383 | A | 7/1985 | Zimmerman | |
| 4,619,372 | A | 10/1986 | McFarland | |
| 4,678,070 | A * | 7/1987 | Light | 192/58.682 |
| 5,799,501 | A | 9/1998 | Leonard et al. | |
| 5,873,493 | A * | 2/1999 | Robinson | 222/109 |
| 6,176,390 | B1 | 1/2001 | Kemp | |
| 6,305,571 | B1 * | 10/2001 | Chu | 220/719 |
| 6,318,584 | B1 * | 11/2001 | Milan | 220/713 |
| 6,488,173 | B2 * | 12/2002 | Milan | 220/713 |
| 6,571,973 | B1 * | 6/2003 | Tripsianes | 222/256 |

* cited by examiner

*Primary Examiner* — Robin Hylton
(74) *Attorney, Agent, or Firm* — Hitchcock Evert LLP

(57) ABSTRACT

A beverage cooling container top apparatus includes a bottom reservoir wall portion which includes a cooling reservoir fill channel. A top reservoir wall portion includes a cooling reservoir access channel. The top reservoir wall provides a closed top. A side wall portion extends between the bottom reservoir wall portion and the top reservoir wall portion. A container-reception portion is connected to the side wall portion. The bottom reservoir wall portion, the top reservoir wall portion, and the side wall portion define a cooling reservoir. Preferably, cooling fins are located on the top reservoir wall portion. A main reservoir access channel can be provided to bypass the cooling reservoir when the contents of the beverage cup are no longer hot. The apparatus of the invention holds and cools a portion of the hot contents of a beverage cup to prevent a user from a very unpleasant burning of the lips and tongue from the hot beverage in the beverage cup.

12 Claims, 4 Drawing Sheets

BEVERAGE CONTAINER TOP HAVING A RESERVOIR FOR LIQUID COOLING

BACKGROUND OF THE INVENTION

1. Field of the Invention

The present invention relates generally to caps (or lids) placed on beverage cups and, more particularly, to caps that are especially adapted for cooling a portion of the contents of the beverage cup.

2. Description of the Prior Art

It is well known that beverages in beverage cups are often too hot to drink safely, without burning one's lips or tongue. To overcome this problem, throughout the years, a number of innovations have been developed relating to lids or caps for beverage cups, whereby the lids or caps provide for cooling a portion of the hot beverage prior to being drunk by the user; and the following U.S. patents are representative of some of those innovations: 3,806,023, 4,619,372, and 6,176,390.

More specifically, each of U.S. Pat. Nos. 3,806,023 4,619, 372, and 6,176,390 discloses a respective lid for a hot liquid drinking cup in which a portion of each respective lid provides a cavity for holding a quantity of hot liquid. Each respective cavity has an open top. As a result, liquid can readily spill out from the respective top if the drinking cup is bumped into. In this respect, it would be desirable if a drinking cup lid, that provides for cooling a portion of the liquid from the cup, were provided with a closed top that prevents spilling of liquid from the lid.

In addition, the following U.S. patents may be of interest for their disclosure of devices for cooling the contents of a beverage cup by cooling the beverage that resides in the beverage cup itself: 4,531,383 and 5,799,501.

Still other features would be desirable in a beverage cooling container cap apparatus. For example, it would be desirable if a cap or lid for a beverage cup could be operated by a user in such a manner that by simply tilting the beverage cup in one direction, the cooling cap or lid fills with hot liquid, and by simply tilting the beverage cup in another direction, the cooled liquid can be readily drunk from the cap or lid by the user.

Thus, while the foregoing body of prior art indicates it to be well known to use a cap or lid for a beverage cup that provides for cooling of a portion of hot liquid from the beverage cup, the prior art described above does not teach or suggest a beverage cooling container cap apparatus which has the following combination of desirable features: (1) provides for cooling a portion of the liquid from the cup and has a closed top that prevents spilling of liquid from the cap; and (2) can be, operated by a user in such a manner that by simply tilting the beverage cup in one direction, the cooling cap or lid fills with hot liquid, and by simply tilting the beverage cup in another direction, the cooled liquid can be readily drunk from the cap or lid by the user. The foregoing desired characteristics are provided by the unique beverage cooling container cap apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a beverage cooling container top apparatus which includes a bottom reservoir wall portion which includes a cooling reservoir fill channel. A top reservoir wall portion includes a cooling reservoir access channel. A side wall portion extends between the bottom reservoir wall portion and the top reservoir wall portion. A container-reception portion is connected to the side wall portion. The bottom reservoir wall portion, the top reservoir wall portion, and the side wall portion define a cooling reservoir. The top reservoir wall provides a closed top.

The cooling reservoir fill channel can be C-shaped. The container-reception portion extends downward from the side wall portion. Preferably, a main reservoir access channel is located in the top reservoir wall portion. The main reservoir access channel provides a direct communication between the contents of the beverage cup and the outside of the beverage cooling container top apparatus, thereby bypassing the cooling reservoir.

Preferably, support pillars are located between the bottom reservoir wall portion and the top reservoir wall portion, and a vent channel is defined by the support pillars. Preferably, cooling fins are located on the top reservoir wall portion. Also, a lip depression can be located in the top reservoir wall portion.

The beverage cooling container top apparatus of the invention is designed for holding and cooling a portion of the hot contents of a beverage cup to prevent a user from a very unpleasant burning of the lips and tongue from the hot beverage in the beverage cup.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved beverage cooling container cap apparatus which has all of the advantages of the prior art and none of the disadvantages.

It is another object of the present invention to provide a new and improved beverage cooling container cap apparatus which may be easily and efficiently manufactured and marketed.

It is a further object of the present invention to provide a new and improved beverage cooling container cap apparatus which is of durable and reliable construction.

An even further object of the present invention is to provide a new and improved beverage cooling container cap apparatus which is susceptible of a low cost of manufacture with regard to both materials and labor, and which accordingly is then, susceptible of low prices of sale to the consuming public, thereby making such beverage cooling container cap apparatus available to the buying public.

Still yet a further object of the present invention is to provide a new and improved beverage cooling container cap apparatus which provides for cooling a portion of the liquid from the cup and has a closed top that prevents spilling of liquid from the cap.

Still another object of the present invention is to provide a new and improved beverage cooling container cap apparatus that can be operated by a user in such a manner that by simply tilting the beverage cup in one direction, the cooling cap or lid fills with hot liquid, and by simply tilting the beverage cup in another direction, the cooled liquid can be readily drunk from the cap or lid by the user.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

Figure 1:
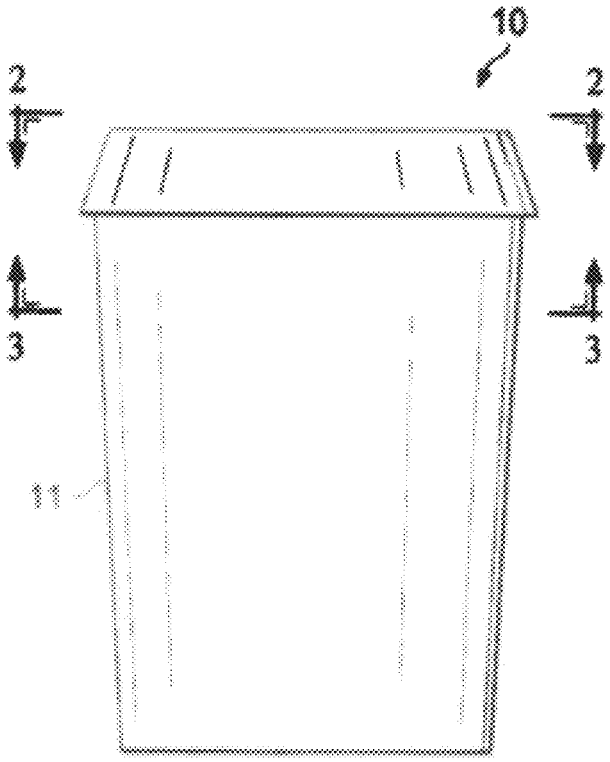
FIG. 1 is a side view showing a preferred embodiment of the beverage cooling container top apparatus of the invention, in place on a beverage cup.

With reference to the drawings, a new and improved beverage cooling container cap apparatus embodying the principles and concepts of the present invention will be described.

Turning to FIGS. 1-6, there is shown a preferred embodiment of the beverage cooling container top apparatus of the invention generally designated by reference numeral 10. In the preferred embodiment, beverage cooling container top apparatus 10 includes a bottom reservoir wall portion 12 which includes a cooling reservoir fill channel 18. A top reservoir wall portion 14 includes a cooling reservoir access channel 22. The top reservoir wall 14 provides a closed top. A side wall portion 32 extends between the bottom reservoir wall portion 12 and the top reservoir wall portion 14. A container-reception portion 34 is connected to the side wall portion 32. The bottom reservoir wall portion 12, the top reservoir wall portion 14, and the side wall portion 32 define a cooling reservoir 16.

Figure 3:
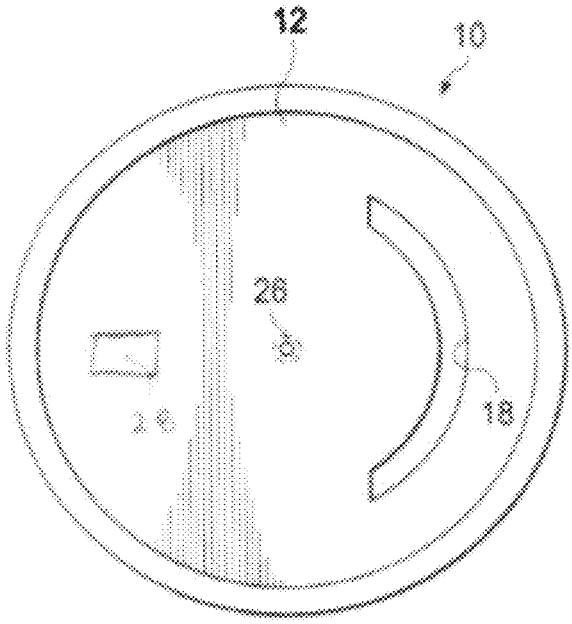
FIG. 3 is a bottom view of the embodiment of the beverage cooling container top apparatus of FIG. 1 taken along line 3-3 thereof, and removed from the beverage cup.
Figure 4:
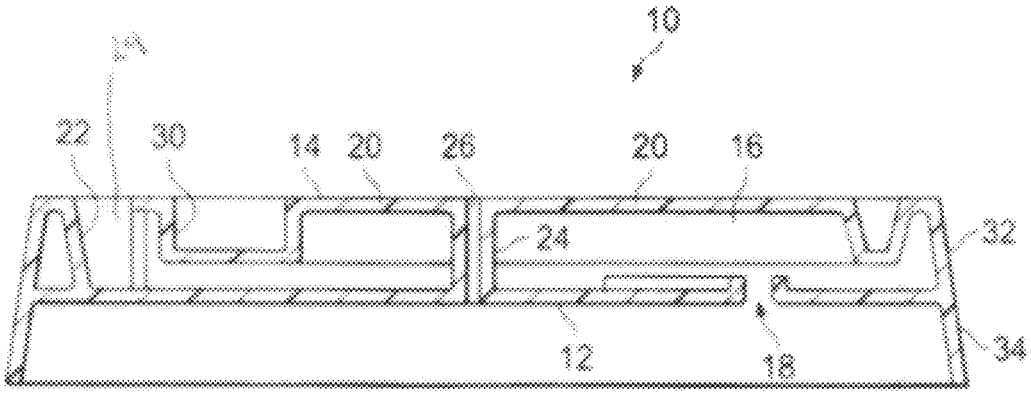
FIG. 4 is an enlarged cross-sectional view of the embodiment of the invention shown in FIG. 2 taken along line 4-4 thereof.

The cooling reservoir fill channel 18 can be arcuate or C-shaped (FIG. 3). The container-reception portion 34 extends downward from the side wall portion 32. Preferably, a main reservoir access channel 28 is located in the top reservoir wall portion 14 and extends to the bottom reservoir wall portion 12. The main reservoir access channel 28 is separated from cooling reservoir access channel 22 by channel wall 29. The main reservoir access channel 28 provides a direct communication between the contents of the beverage cup 11 and the outside of the beverage cooling container top apparatus 10, thereby bypassing the cooling reservoir 16.

Preferably, support pillars 24 are located between the bottom reservoir wall portion 12 and the top reservoir wall portion 14, and a vent channel 26 is defined by the support pillars 24. Preferably, cooling fins 20 are located on the top reservoir wall portion 14. Also, a lip depression 30 can be located in the top reservoir wall portion 14.

Generally, a beverage cup 11 that is designed for holding a high temperature beverage is made from a material that is a good heat insulator, such as styrofoam. Such beverage cups 11 are used for holding hot beverages such as coffee, tea, hot chocolate, etc. It is not uncommon for the beverage to be too hot to drink directly for the first 5 to 15 minutes. If drinking the hot beverage prematurely is attempted, it frequently results in a very unpleasant burning of the lips and tongue.

A conventional cap or lid for such a beverage cup 11 generally is made from a thin disposable plastic material that is a relatively good conductor of heat, compared with the material that forms the heat insulating beverage cup 11. Preferably, the beverage cooling container top apparatus 10 of the invention is made from such a plastic material that is a relatively good conductor of heat.

Figure 5:
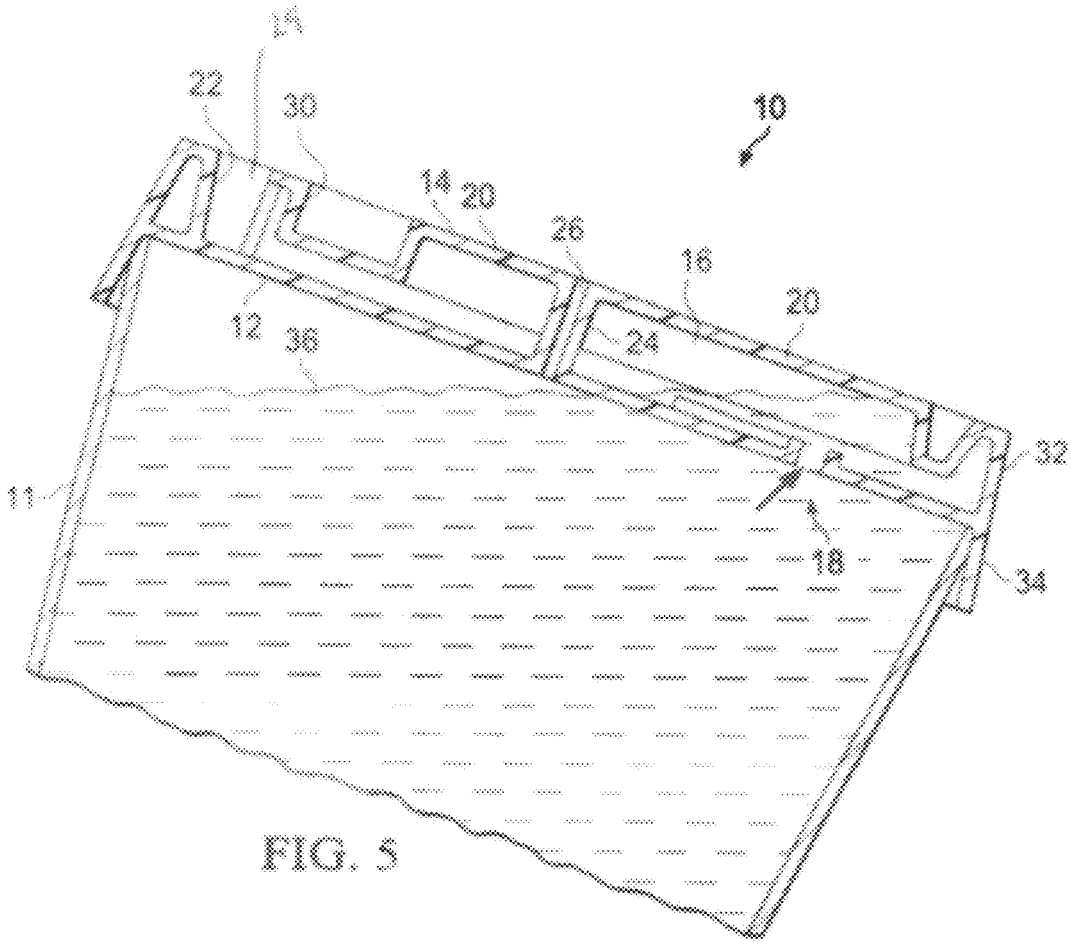
FIG. 5 is a cross-sectional view of the embodiment of the invention shown in FIGS. 1-4, in use on a beverage cup, and in a position for loading the beverage cooling container top apparatus with beverage from the beverage cup.
Figure 6:
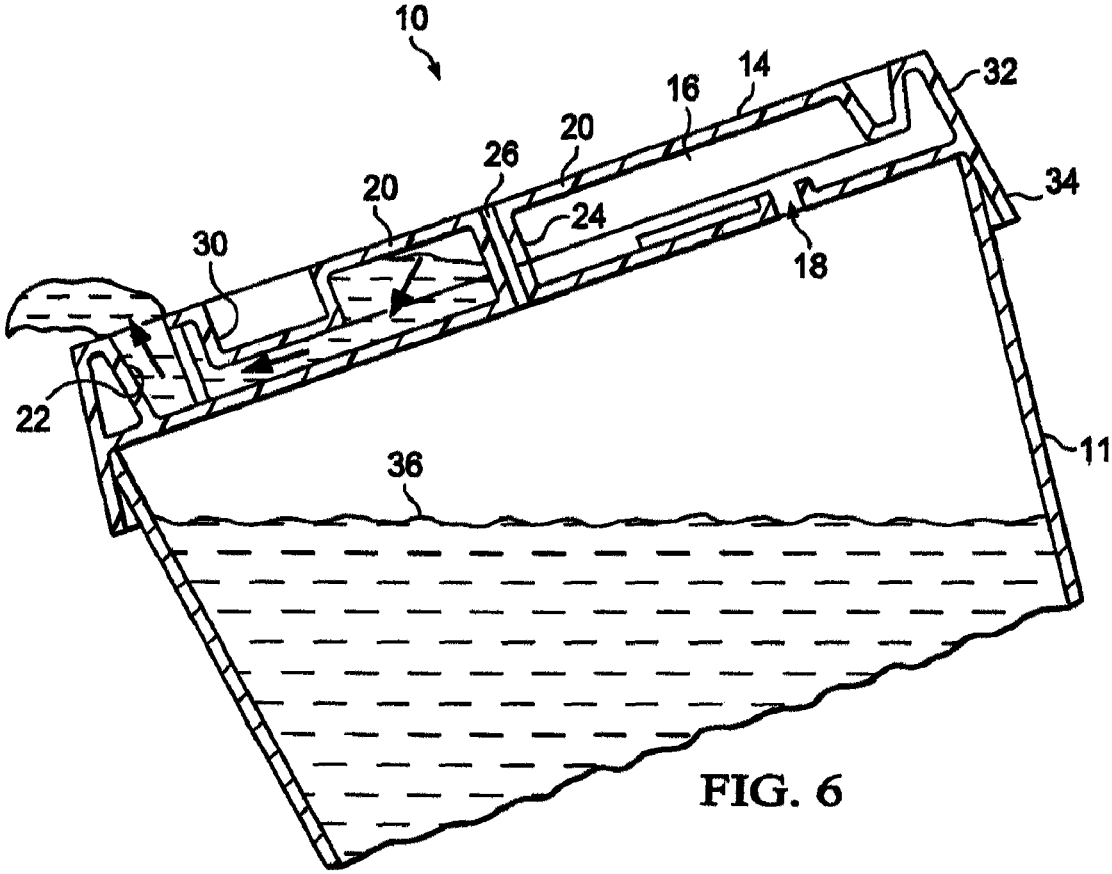
FIG. 6 is a cross-sectional view of the embodiment of the invention shown in FIGS. 1-4, in use on a beverage cup, and in a position for dispensing beverage from the beverage cooling container top apparatus.
Figure 1:
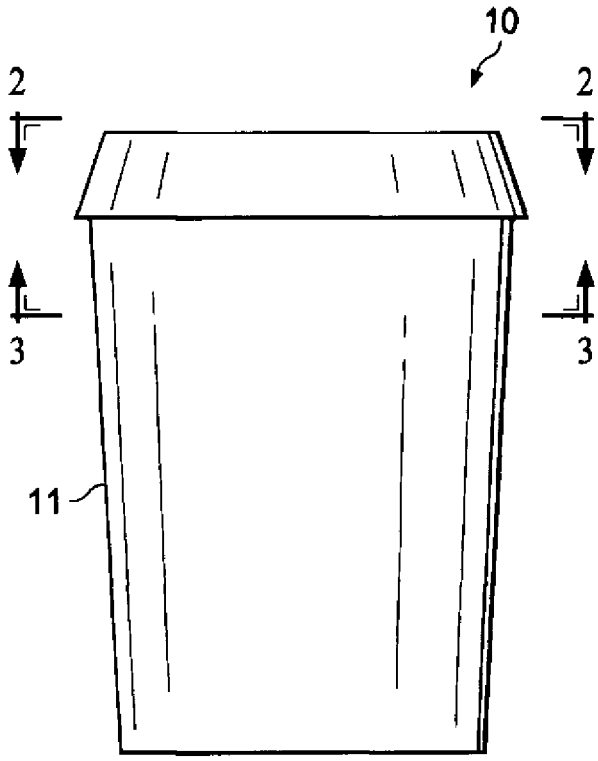
Figure 2:
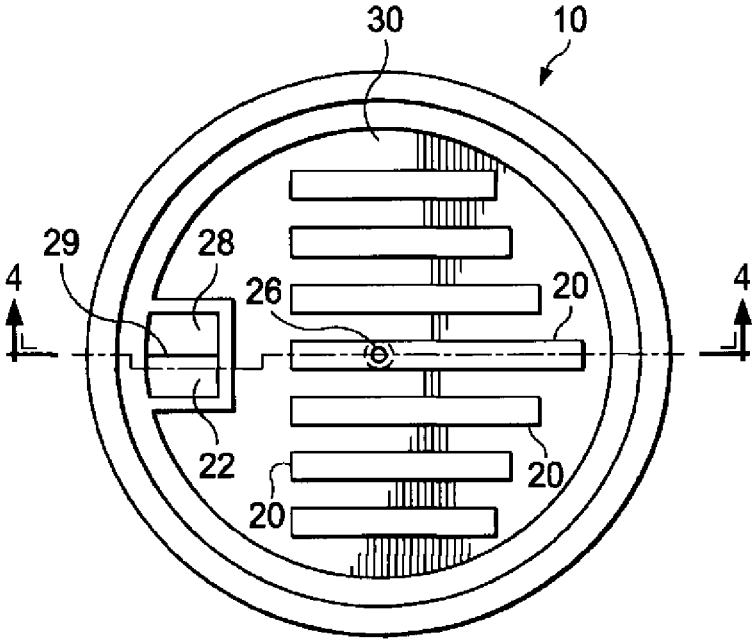
Figure 3:
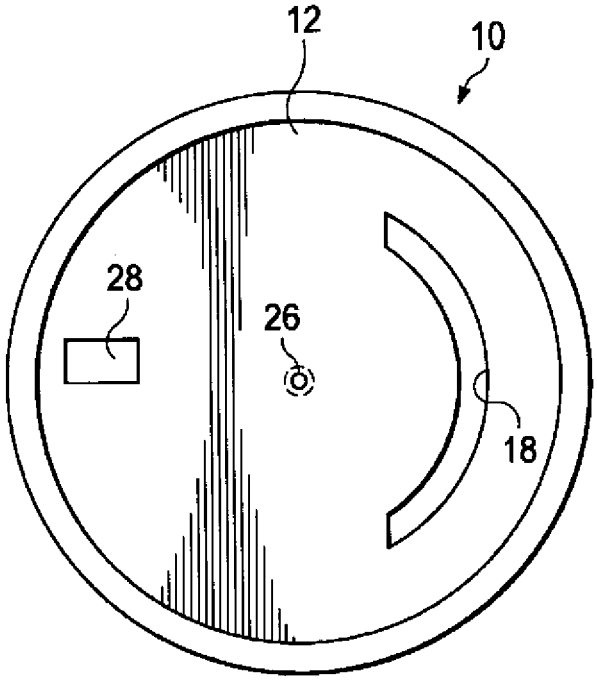
Figure 4:
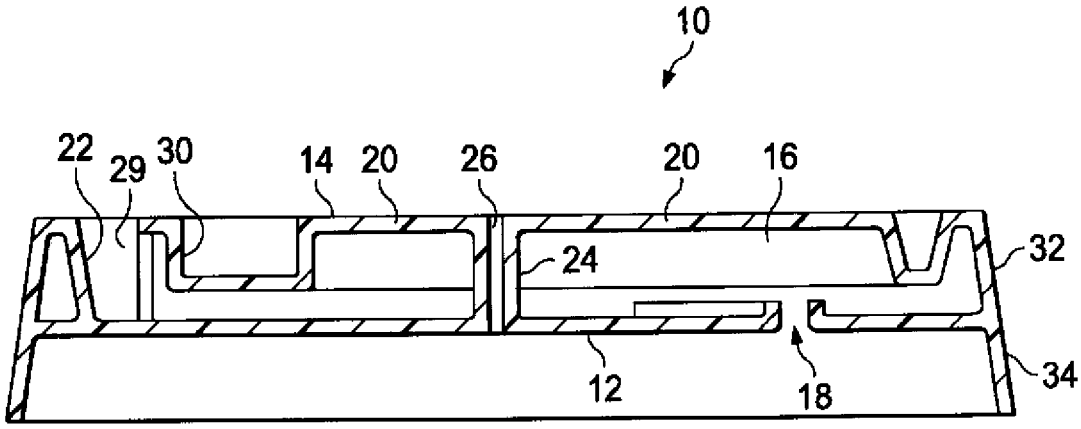
Figure 5:
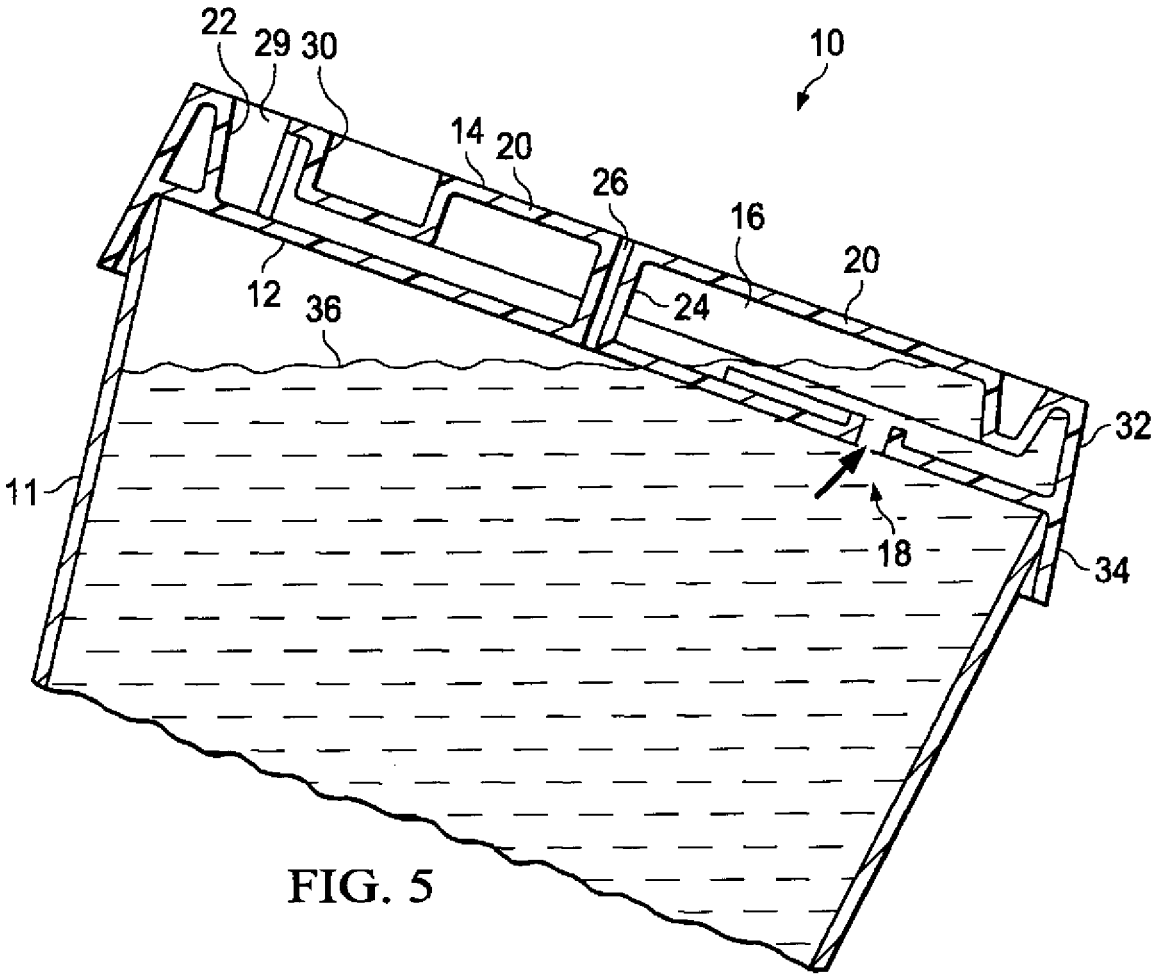
Figure 6:
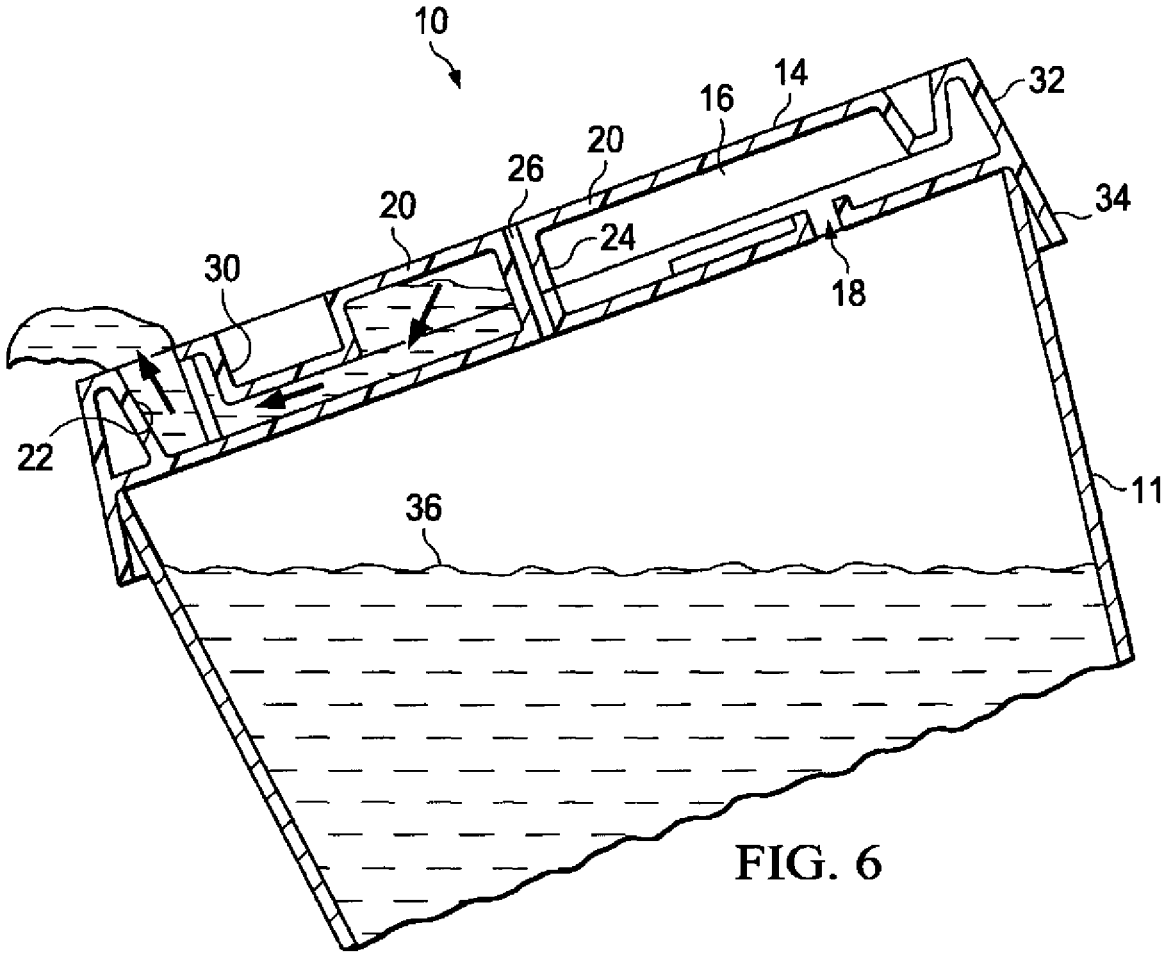
Figure 1:
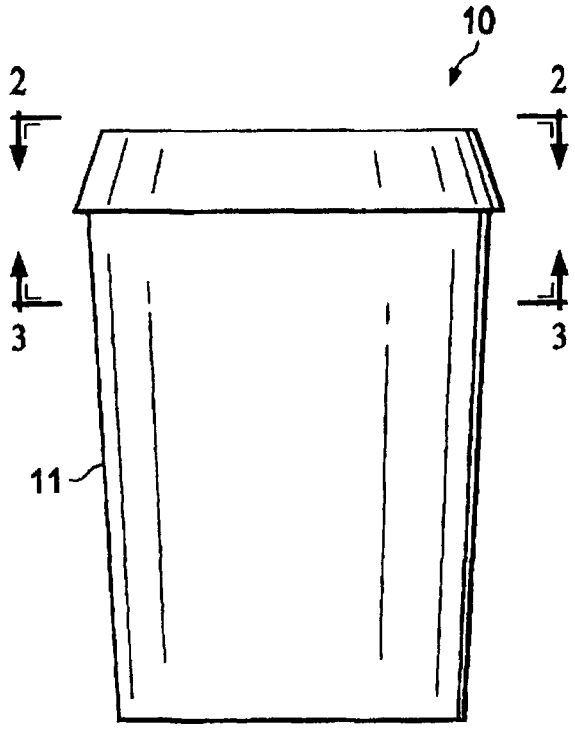
Figure 2:
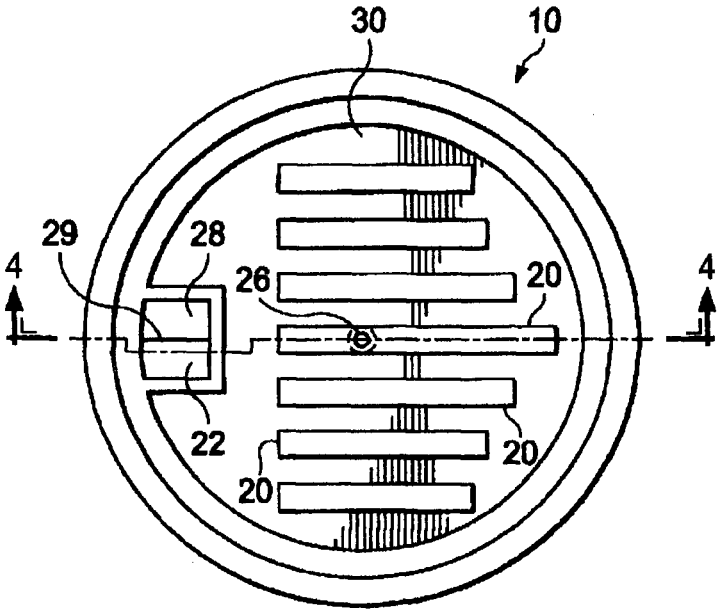
Figure 3:
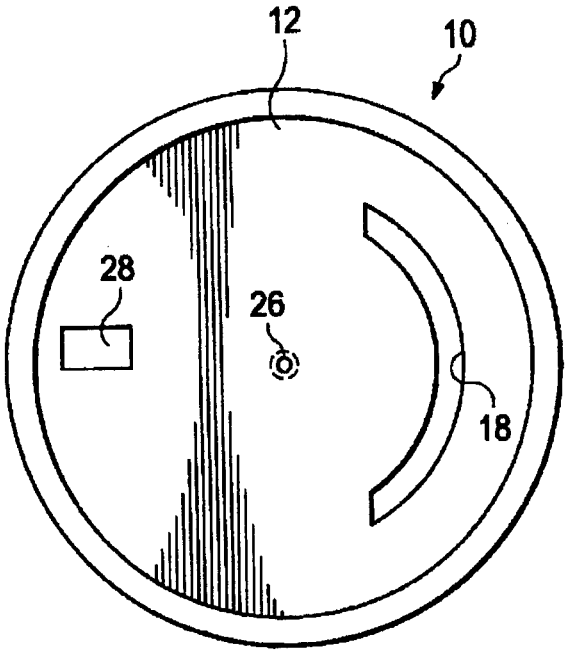
Figure 4:
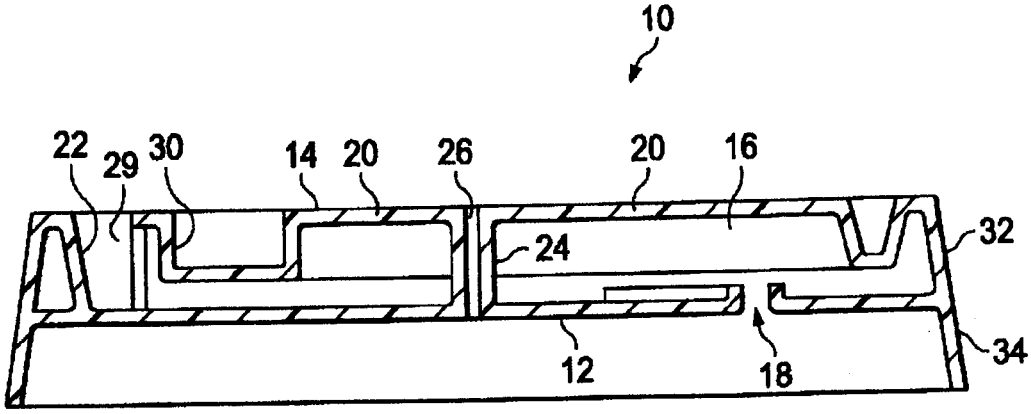
Figure 5:
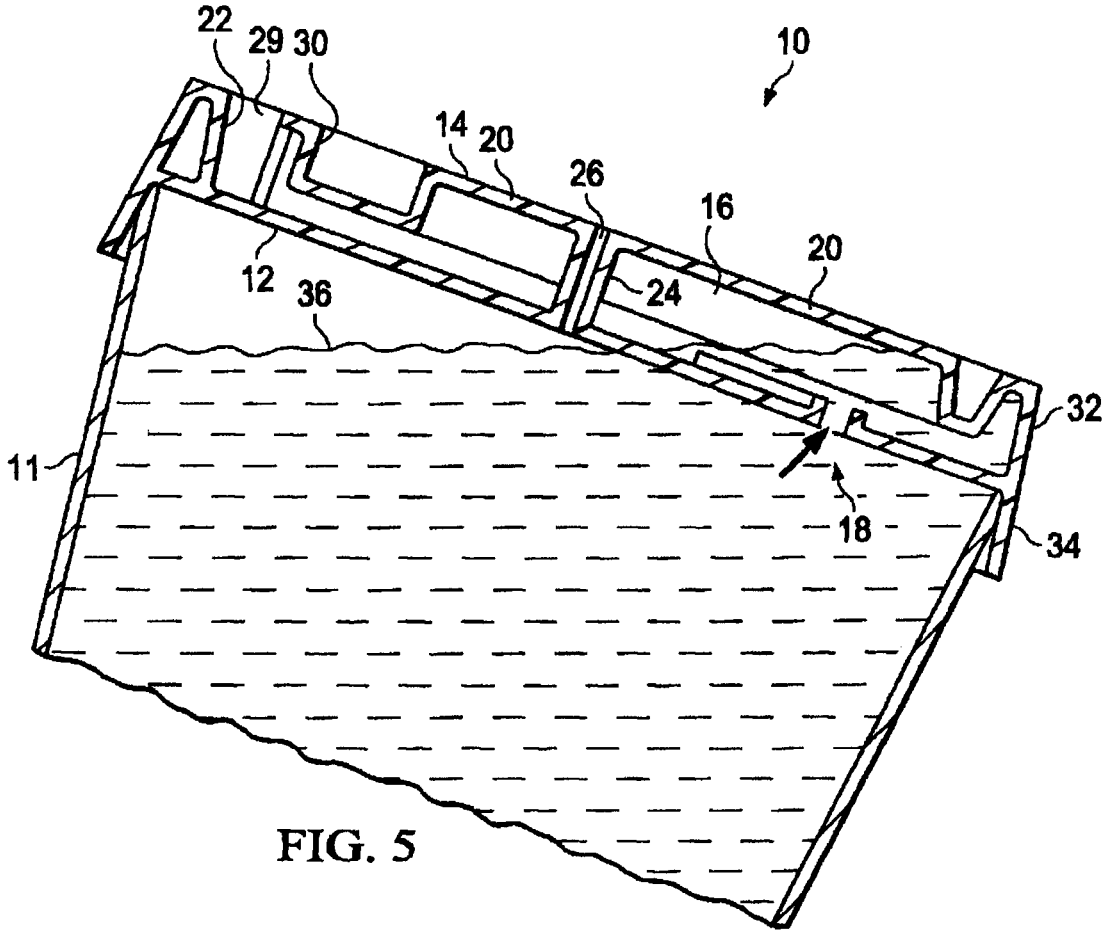
Figure 6:
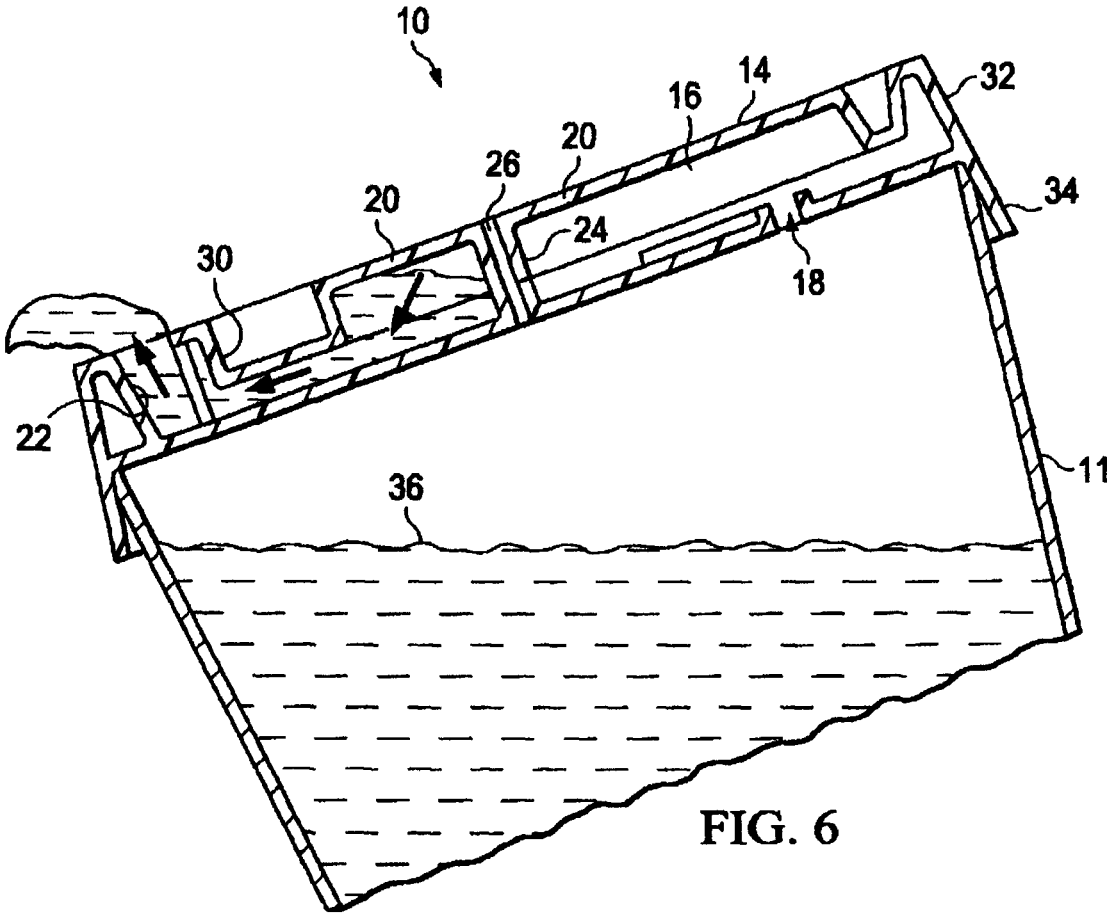

As shown in FIG. 1, the beverage cooling container top apparatus 10 of the invention is attached to the top of a beverage cup 11. The container-reception portion 34 of the apparatus grips the top of the beverage cup 11 and forms a liquid-tight seal between the beverage cooling container top apparatus 10 and the beverage cup 11. As shown in FIGS. 1, 5, and 6, the container-reception portion 34 can be formed as a wedge-shaped ring that receives the top rim of the beverage cup 11.

To operate the beverage cooling container top apparatus 10 of the invention, reference is made to FIG. 5. In FIG. 5, the cup and its liquid contents 36 are tilted slightly away from the user so that some of the liquid contents 36 pass through the cooling reservoir fill channel 18 and into the cooling reservoir 16. Then, the cup can be levelled (not shown). In the levelled condition, some of the liquid contents 36 remain in the cooling reservoir 16 where that portion of the liquid contents 36 can cool more rapidly than the liquid contents 36 that remain in the beverage cup 11.

After a few minutes in the cooling reservoir 16, the beverage cup 11 and beverage cooling container top apparatus 10 can be tilted slightly forward, such as shown in FIG. 6. The cooled liquid contents 36 can pour out from the cooling reservoir access channel 22 and is drunk by the user.

This procedure of loading the cooling reservoir 16, allowing the liquid contents 36 in the cooling reservoir 16 to cool, and drinking the cooled liquid contents 36 can be repeated as many times as desired.

Figure 2:
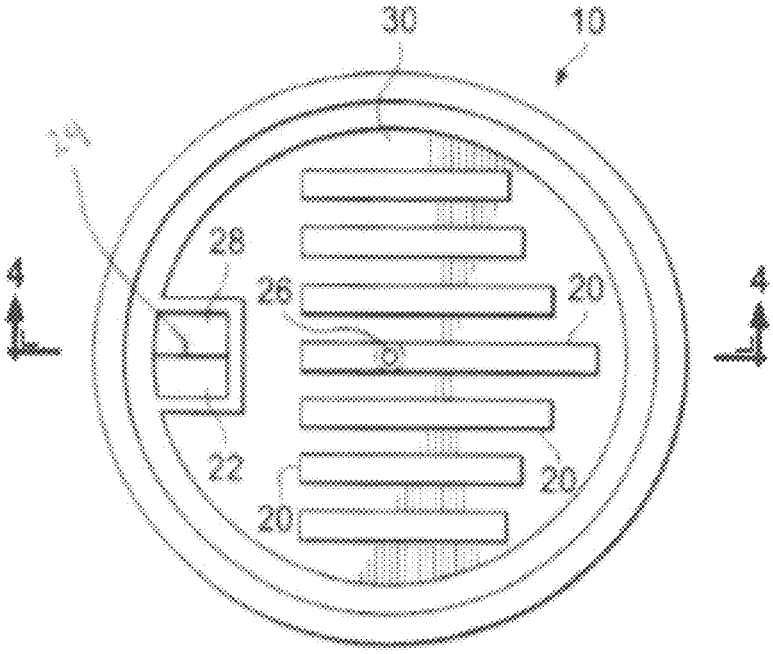
FIG. 2 is a top view of the embodiment of the beverage cooling container top apparatus shown in FIG. 1 taken along line 2-2 of FIG. 1.

Once the temperature of the liquid contents 36 of the beverage cup 11 reaches a comfortable temperature, then the beverage cup 11 and the beverage cooling container top apparatus 10 can be tilted at a slightly greater angle toward the user (not shown) so that the user can consume the contents of the beverage cup 11 directly from the beverage cup 11 through the main reservoir access channel 28, which is shown in FIGS. 2 and 3. There is a direct communication between the main reservoir access channel 28 and the inside contents of the beverage cup 11.

The beverage cooling container top apparatus 10 has a vent channel 26 to allow venting of very hot liquid vapors from inside the beverage cup 11. Also, the beverage cooling container top apparatus 10 has a lip depression 30 which is of a lower profile than the cooling fins 20 on the top reservoir wall portion 14.

The components of the beverage cooling container top apparatus of the invention can be made from inexpensive and durable disposable plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved beverage cooling container cap apparatus that is low in cost, relatively simple in design and operation, and which may advantageously be used to provide for cooling a portion of the liquid from the cup and which has a closed top that prevents spilling of liquid from the cap. Also, with the invention, a beverage cooling container cap apparatus is provided which can be operated by a user in such a manner that by simply tilting the beverage cup in one direction, the cooling cap or lid fills with hot liquid, and by simply tilting the beverage cup in another direction, the cooled liquid can be readily drunk from the cap or lid by the user.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A beverage cooling container top apparatus, comprising:

a bottom reservoir wall portion which includes a cooling reservoir fill channel;

a top reservoir wall portion which includes a cooling reservoir access channel;

a side wall portion which extends between said bottom reservoir wall portion and said top reservoir wall portion;

a container-reception portion extending downward from a lower edge of said side wall portion, wherein said bottom reservoir wall portion, said top reservoir wall portion, and said side wall portion define a cooling reservoir; and a main reservoir access channel located in said top reservoir wall portion adjacent to said cooling reservoir access channel, wherein said main reservoir access channel comprises a cooling reservoir bypass which extends to said bottom reservoir wall portion and provides a direct communication between contents of the main reservoir and the outside of said beverage cooling container top apparatus, thereby enabling a consumer to bypass said cooling reservoir.

2. The beverage cooling container top apparatus of claim 1 wherein said cooling reservoir fill channel is arcuately shaped.

3. A beverage cooling container top apparatus, comprising:

a bottom reservoir wall portion which includes a cooling reservoir fill channel;

a top reservoir wall portion which includes a cooling reservoir access channel;

a side wall portion which extends between said bottom reservoir wall portion and said top reservoir wall portion;

a container-reception portion extending downward from a lower edge of said side wall portion, wherein said bottom reservoir wall portion, said top reservoir wall portion, and said side wall portion define a cooling reservoir;

support pillars located between said cooling reservoir fill channel and said cooling reservoir access channel and extending between said bottom reservoir wall portion and said top reservoir wall portion; and a vent channel defined by said support pillars.

4. A beverage cooling container top apparatus, comprising:

a bottom reservoir wall portion which includes a cooling reservoir fill channel;

a top reservoir wall portion which includes a cooling reservoir access channel;

a side wall portion which extends between said bottom reservoir wall portion and said top reservoir wall portion;

a container-reception portion extending downward from a lower edge of said side wall portion, wherein said bottom reservoir wall portion, said top reservoir wall portion, and said side wall portion define a cooling reservoir; and cooling fins located between said cooling reservoir fill channel and said cooling reservoir access channel and located on said top reservoir wall portion, wherein said cooling fins extend above other portions of said top reservoir wall portion.

5. The beverage cooling container top apparatus of claim 4, further including:

a lip depression located in said top reservoir wall portion at least partially surrounding said cooling reservoir access channel.

6. The beverage cooling container top apparatus of claim 1, further including:

support pillars located between said cooling reservoir fill channel and said cooling reservoir access channel and extending between said bottom reservoir wall portion and said top reservoir wall portion, and a vent channel defined by said support pillars.

7. The beverage cooling container top apparatus of claim 1, further including:

cooling fins located between said cooling reservoir fill channel and said cooling reservoir access channel and located on said top reservoir wall portion, wherein said cooling fins extend above other portions of said top reservoir wall portion.

8. The beverage cooling container top apparatus of claim 3, further including:

a lip depression located in said top reservoir wall portion at least partially surrounding said cooling reservoir access channel.

9. The beverage cooling container top apparatus of claim 3, further including:

cooling fins located between said cooling reservoir fill channel and said cooling reservoir access channel and located on said top reservoir wall portion, wherein said cooling fins extend above other portions of said top reservoir wall portion.

10. The beverage cooling container top apparatus of claim 1, further comprising a forward portion and a rearward portion, wherein said cooling reservoir fill channel is located in the rearward portion of said beverage cooling container top apparatus and said cooling reservoir access channel is located in the forward portion of said beverage cooling container top apparatus.

11. The beverage cooling container top apparatus of claim 3, further comprising a forward portion and a rearward portion, wherein said cooling reservoir fill channel is located in the rearward portion of said beverage cooling container top apparatus and said cooling reservoir access channel is located in the forward portion of said beverage cooling container top apparatus.

12. The beverage cooling container top apparatus of claim 4, further comprising a forward portion and a rearward portion, wherein said cooling reservoir fill channel is located in the rearward portion of said beverage cooling container top apparatus and said cooling reservoir access channel is located in the forward portion of said beverage cooling container top apparatus.

* * * * *

UNITED STATES PATENT AND TRADEMARK OFFICE

CERTIFICATE OF CORRECTION

PATENT NO. : 8,267,275 B2
APPLICATION NO. : 11/009933
DATED : September 18, 2012
INVENTOR(S) : Stig E. Peitersen It is certified that error appears in the above-identified patent and that said Letters Patent is hereby corrected as shown below:

Delete Drawing Figures 1-4, and replace with attached Drawing Figures 1-4.

Signed and Sealed this
Fifteenth Day of January, 2013

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,267,275 B2
APPLICATION NO. : 11/009933
DATED : September 18, 2012
INVENTOR(S) : Stig E. Peitersen It is certified that error appears in the above-identified patent and that said Letters Patent is hereby corrected as shown below:

Delete the title page and substitute therefore the attached title page showing the corrected illustrative figure.

Delete Drawing Sheets 1-4, and replace with attached Drawing Sheets 1-4 consisting of replacement FIGS. 1-6.

This certificate supersedes the Certificate of Correction issued January 15, 2013.

Signed and Sealed this
Nineteenth Day of February, 2013

Teresa Stanek Rea
*Acting Director of the United States Patent and Trademark Office*

(12) United States Patent
Peitersen

(10) Patent No.: US 8,267,275 B2
(45) Date of Patent: Sep. 18, 2012

(54) BEVERAGE CONTAINER TOP HAVING A RESERVOIR FOR LIQUID COOLING

(75) Inventor: Stig E. Peitersen, Lufkin, TX (US)

(73) Assignee: Stig E. Peitersen, Lufkin, TX (US)

( * ) Notice: Subject to any disclaimer, the term of this patent is extended or adjusted under 35 U.S.C. 154(b) by 1587 days.

(21) Appl. No.: 11/009,933

(22) Filed: Dec. 11, 2004

(65) Prior Publication Data

US 2006/0124645 A1 Jun. 15, 2006

(51) Int. Cl.

| | |
|---|---|
| ***B65D 51/16*** | (2006.01) |
| ***B65D 1/24*** | (2006.01) |
| ***A47G 19/22*** | (2006.01) |
| *B65D 3/00* | (2006.01) |

(52) U.S. Cl. ..... 220/374; 220/713; 220/718; 220/719; 220/521; 229/404

(58) Field of Classification Search ..... 220/521, 220/713, 719, 374, 373, 367.1, 716, 717, 220/711.368, 718; 229/404, 906.1
See application file for complete search history.

(56) References Cited

U.S. PATENT DOCUMENTS

| | | | | |
|---|---|---|---|---|
| 3,806,023 | A | 4/1974 | Barnett | |
| 4,460,101 | A * | 7/1984 | Tseng | 215/307 |
| 4,531,383 | A | 7/1985 | Zimmerman | |
| 4,619,372 | A | 10/1986 | McFarland | |
| 4,678,070 | A * | 7/1987 | Light | 192/58.682 |
| 5,799,501 | A | 9/1998 | Leonard et al. | |
| 5,873,493 | A * | 2/1999 | Robinson | 222/109 |
| 6,176,390 | B1 | 1/2001 | Kemp | |
| 6,305,571 | B1 * | 10/2001 | Chu | 220/719 |
| 6,318,584 | B1 * | 11/2001 | Milan | 220/713 |
| 6,488,173 | B2 * | 12/2002 | Milan | 220/713 |
| 6,571,973 | B1 * | 6/2003 | Tripsianes | 222/256 |

* cited by examiner

*Primary Examiner* — Robin Hylton
(74) *Attorney, Agent, or Firm* — Hitchcock Evert LLP

(57) ABSTRACT

A beverage cooling container top apparatus includes a bottom reservoir wall portion which includes a cooling reservoir fill channel. A top reservoir wall portion includes a cooling reservoir access channel. The top reservoir wall provides a closed top. A side wall portion extends between the bottom reservoir wall portion and the top reservoir wall portion. A container-reception portion is connected to the side wall portion. The bottom reservoir wall portion, the top reservoir wall portion, and the side wall portion define a cooling reservoir. Preferably, cooling fins are located on the top reservoir wall portion. A main reservoir access channel can be provided to bypass the cooling reservoir when the contents of the beverage cup are no longer hot. The apparatus of the invention holds and cools a portion of the hot contents of a beverage cup to prevent a user from a very unpleasant burning of the lips and tongue from the hot beverage in the beverage cup.

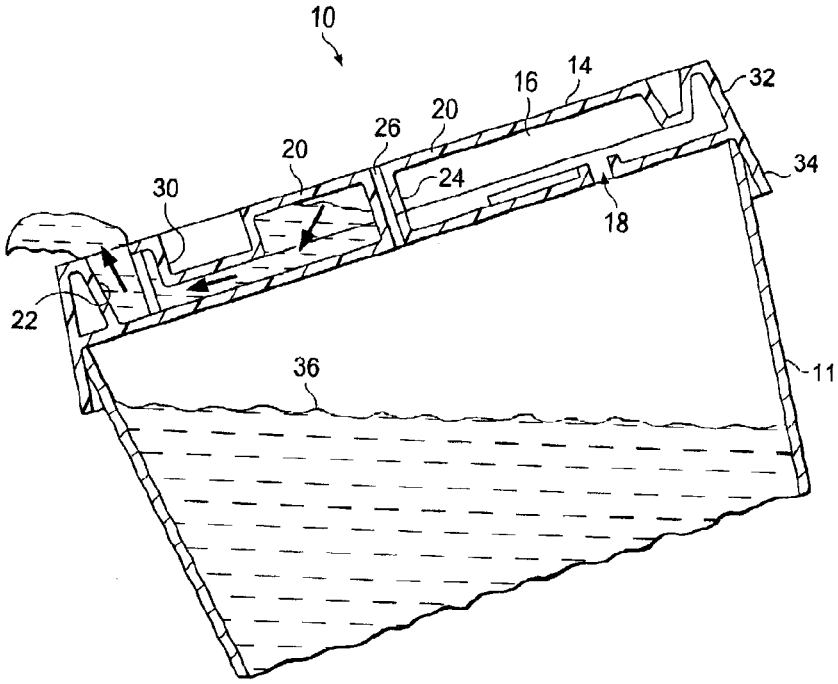

12 Claims, 4 Drawing Sheets